US009833876B2

(12) United States Patent
Chan

(10) Patent No.: US 9,833,876 B2
(45) Date of Patent: Dec. 5, 2017

(54) POLISHING APPARATUS AND POLISHING METHOD

(71) Applicant: Taiwan Semiconductor Manufacturing Co., Ltd, Hsin-Chu (TW)

(72) Inventor: I-Pin Chan, Chu-Pei (TW)

(73) Assignee: TAIWAN SEMICONDUCTOR MANUFACTURING CO., LTD., Hsin-Chu (TW)

( * ) Notice: Subject to any disclaimer, the term of this patent is extended or adjusted under 35 U.S.C. 154(b) by 640 days.

(21) Appl. No.: 14/195,020

(22) Filed: Mar. 3, 2014

(65) Prior Publication Data

US 2015/0246425 A1 Sep. 3, 2015

(51) Int. Cl.
*B24B 53/017* (2012.01)
*B24B 37/34* (2012.01)

(52) U.S. Cl.
CPC ..... *B24B 53/017* (2013.01); *B24B 37/34* (2013.01)

(58) Field of Classification Search
CPC ..... B24B 53/017; B24B 53/12; B24B 37/34
USPC ..... 451/443, 444, 446, 60, 72, 56, 450
See application file for complete search history.

(56) References Cited

U.S. PATENT DOCUMENTS 5,616,069 A * 4/1997 Walker ..... B08B 3/02 134/153
5,716,264 A * 2/1998 Kimura ..... B24B 53/017 451/285
6,283,840 B1 * 9/2001 Huey ..... B24B 57/02 451/288
6,319,098 B1 * 11/2001 Osterheld ..... B24B 37/04 451/444
6,358,124 B1 * 3/2002 Koga ..... B08B 1/007 451/444
6,685,796 B1 * 2/2004 Lin ..... B24B 57/02 156/345.1
2002/0039880 A1 * 4/2002 Torii ..... B24B 37/04 451/446
2003/0199229 A1 * 10/2003 Vereen ..... B24B 57/02 451/36
2004/0162007 A1 * 8/2004 Phan ..... B24B 53/017 451/36
2006/0073773 A1 * 4/2006 Exley ..... B24B 53/017 451/56
2007/0298692 A1 * 12/2007 Mavliev ..... B24B 53/017 451/56
2010/0048106 A1 * 2/2010 Wang ..... B24B 37/04 451/60
2013/0023186 A1 * 1/2013 Motoshima ..... B24B 55/02 451/7
2014/0273763 A1 * 9/2014 Lee ..... B24B 53/017 451/56

(Continued)

*Primary Examiner* — Monica Carter
*Assistant Examiner* — Marcel Dion
(74) *Attorney, Agent, or Firm* — McClure, Qualey & Rodack, LLP

(57) ABSTRACT

Embodiments of a polishing apparatus are provided. The polishing apparatus includes a polishing pad having a polishing surface. The polishing apparatus also includes a dispensing device including a dispensing arm located over the polishing pad and a liquid nozzle disposed on the dispensing arm. The liquid nozzle is configured to dispense washing liquid onto the polishing surface along a dispensing direction. The dispensing direction has an acute angle with respect to the polishing surface.

20 Claims, 10 Drawing Sheets

(56) References Cited

U.S. PATENT DOCUMENTS

2014/0352608 A1* 12/2014 Ishibashi ..... B24B 37/04
118/52
2015/0165588 A1* 6/2015 Chou ..... B24B 53/017
451/56

* cited by examiner

POLISHING APPARATUS AND POLISHING METHOD

BACKGROUND

Semiconductor devices are used in a variety of electronic applications, such as personal computers, cell phones, digital cameras, and other electronic equipment. Semiconductor devices are typically fabricated by sequentially depositing insulating or dielectric layers, conductive layers, and semiconductive layers of material over a semiconductor substrate, and patterning the various material layers using lithography to form circuit components and elements thereon. Many integrated circuits are typically manufactured on a single semiconductor wafer, and individual dies on the wafer are singulated by sawing between the integrated circuits along a scribe line. The individual dies are typically packaged separately, in multi-chip modules, or in other types of packaging, for example.

After the material is deposited on the wafer by a chemical vapor deposition (CVD) process, for example, the wafer is polished by a chemical mechanical polishing (CMP) process in a CMP apparatus. Although existing devices and methods for CMP process have been generally adequate for their intended purposes, they have not been entirely satisfactory in all respects. Consequently, it would be desirable to provide a solution for polishing wafers in CMP apparatuses.

BRIEF DESCRIPTION OF THE DRAWINGS

For a more complete understanding of the present disclosure, and the advantages of the present disclosure, reference is now made to the following descriptions taken in conjunction with the accompanying drawings, in which.

DETAILED DESCRIPTION

The making and using of various embodiments of the disclosure are discussed in detail below. It should be appreciated, however, that the various embodiments can be embodied in a wide variety of specific contexts. The specific embodiments discussed are merely illustrative, and do not limit the scope of the disclosure.

It should be understood that the following disclosure provides many different embodiments, or examples, for implementing different features of the disclosure. Specific examples of components and arrangements are described below to simplify the present disclosure. These are, of course, merely examples and are not intended to be limiting. Moreover, the performance of a first process before a second process in the description that follows may include embodiments in which the second process is performed immediately after the first process, and may also include embodiments in which additional processes may be performed between the first and second processes. Various features may be arbitrarily drawn in different scales for the sake of simplicity and clarity. Furthermore, the formation of a first feature over or on a second feature in the description may include embodiments in which the first and second features are formed in direct or indirect contact.

Some variations of the embodiments are described. It is understood that additional operations can be provided before, during, and after the method, and some of the operations described can be replaced or eliminated for other embodiments of the method.

Embodiments of a polishing apparatus are provided. The polishing apparatus is configured to polish wafers on a polishing pad by a polish process and clean particles remaining on the polishing pad.

Figure 1:
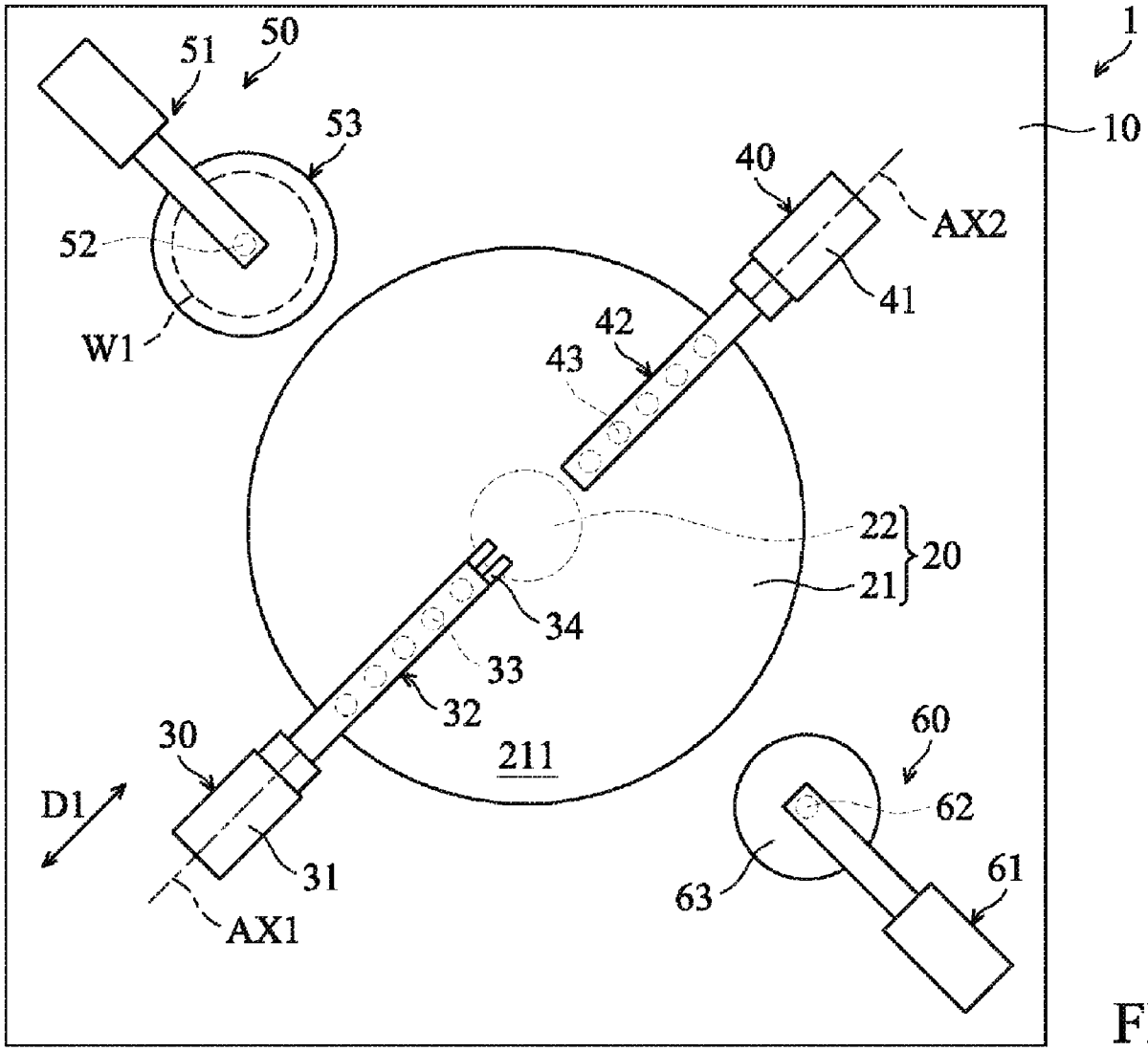
FIG. 1 is a schematic view of a polishing apparatus in accordance with some embodiments of the disclosure.
Figure 2:
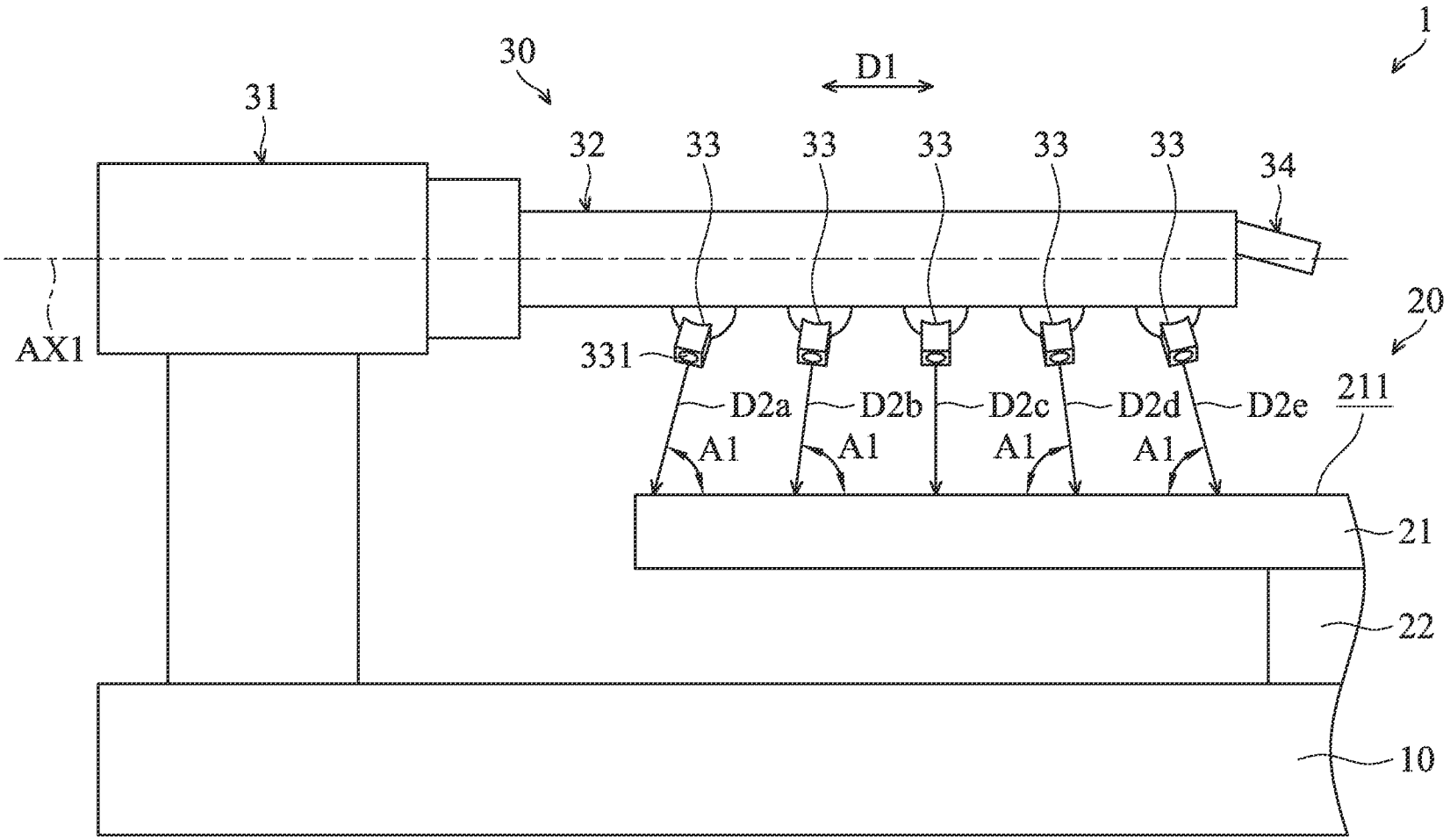
FIG. 2 is a side view of a polishing apparatus in accordance with some embodiments of the disclosure.

FIG. 1 is a schematic view of a polishing apparatus 1 in accordance with some embodiments of the disclosure. FIG. 2 is a side view of the polishing apparatus 1 in accordance with some embodiments of the disclosure. In some embodiments, the polishing apparatus 1 is a chemical mechanical polishing (CMP) apparatus. The polishing apparatus 1 is configured to polish a wafer W1. The polishing apparatus 1 includes a base 10, a polishing device 20, a first dispensing device 30, a second dispensing device 40, a retaining device 50, and a roughening device 60.

The polishing device 20 is disposed on the base 10. The polishing device 20 is configured to polish the wafer W1. The polishing device 20 includes a polishing pad 21 and a rotation mechanism 22. The polishing pad 21 is configured to polish the wafer W1. The polishing pad 21 is disposed on the rotation mechanism 22. The rotation mechanism 22 is disposed on the base 10. The rotation mechanism 22 is configured to rotate the polishing pad 21.

In some embodiments, the diameter of the polishing pad 21 is about two times to about four times of the diameter of the wafer W1. In some embodiments, the wafer W1 has a diameter in a range from about 200 mm to about 600 mm. For example, the wafer W1 has a diameter about 300 mm or 450 mm. In some embodiments, the polishing pad 21 has a diameter in a range from about 400 mm to 2000 mm. For example, the polishing pad 21 has a diameter in a range from about 600 mm to about 1000 mm.

As shown in FIGS. 1 and 2, the first dispensing device 30 is disposed on the base 10. The first dispensing device 30 is configured to dispense slurry and washing liquid onto a polishing surface 211 of the polishing pad 21. In some embodiments, the washing liquid is water or deionized water. The first dispensing device 30 includes a first support 31, a first dispensing arm 32, a number of first liquid nozzles 33, and a number of slurry nozzles 34. The first support 31 is disposed on the base 10.

The first dispensing arm 32 is disposed on the first support 31. The first dispensing arm 32 is located over the polishing pad 21. In some embodiments, the first dispensing arm 32 is a linear structure extended along a first extension axis AX1. In some embodiments, the first extension axis AX1 is parallel to the polishing surface 211. The first extension axis AX1 substantially passes though the center of the polishing pad 21. In some embodiments, the first dispensing arm 32 is a telescoping dispensing arm.

The first liquid nozzles 33 are disposed on the first dispensing arm 32. In some embodiments, the first liquid nozzles 33 are arranged on the first dispensing arm 32 along an extension direction D1. In some embodiments, the extension direction D1 is parallel to the first extension axis AX1. The first liquid nozzles 33 are configured to dispense washing liquid onto the polishing surface 211. In some embodiments, the washing liquid is water or deionized water.

Figure 3:
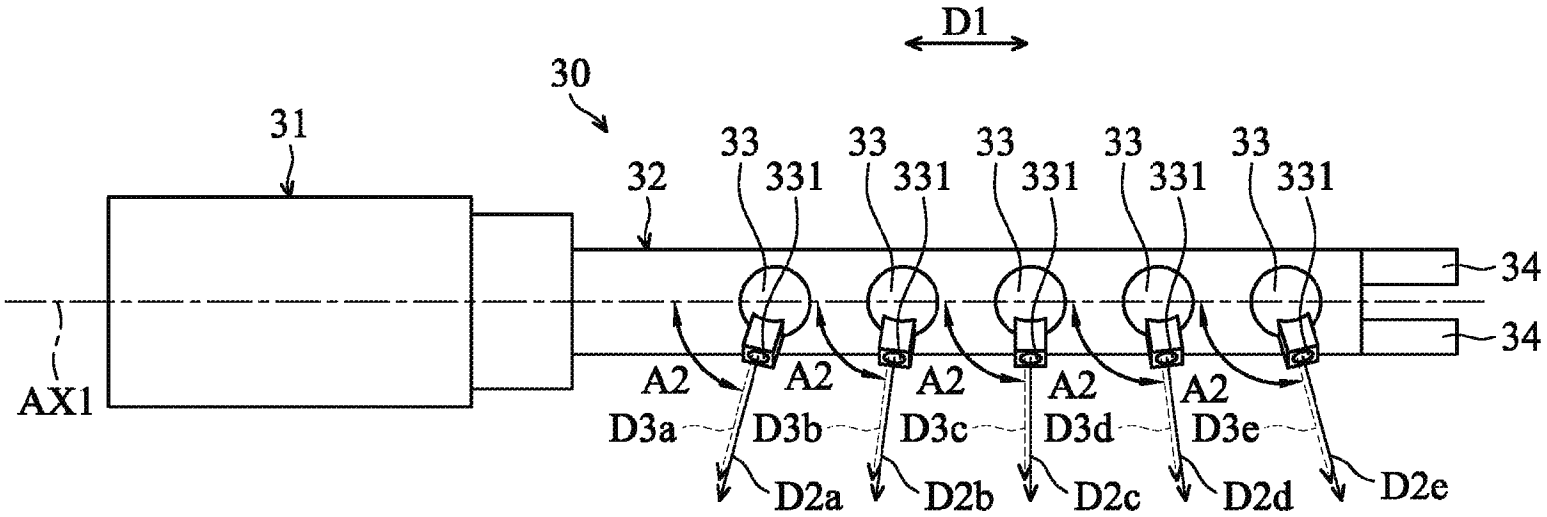
FIG. 3 is a top view of a dispensing device in accordance with some embodiments of the disclosure.

FIG. 3 is a top view of the first dispensing device 30 in accordance with some embodiments of the disclosure. As show in FIGS. 2 and 3, in some embodiments, each of the first liquid nozzles 33 faces different directions. Therefore, the first liquid nozzles 33 dispense washing liquid toward different directions. In some embodiments, each of the angles of the first liquid nozzles 33 is adjustable. In some embodiments, at least two of the first liquid nozzles 33 face the same direction. In some embodiments, all of the first liquid nozzles 33 face the same direction.

For example, in some embodiments, the first liquid nozzles 33 are respectively extended along the dispensing directions D2*a*, D2*b*, D2*c*, D2*d* and D2*e*. The openings 331 of the first liquid nozzles 33 are respectively perpendicular to the dispensing directions D2*a* to D2*e*. The first liquid nozzles 33 respectively dispense the washing liquid onto the polishing surface 211 along dispensing directions D2*a* to D2*e*.

The dispensing directions D2*a* to D2*e* have acute angles A1 with respect to the polishing surface 211. The acute angles A1 are in a range from about 20 degrees to about 80 degrees. As shown in FIGS. 2 and 3, the dispensing directions D2*a* to D2*e* are different to each other. In some embodiments, at least two of the dispensing directions D2*a* to D2*e* are the same. In some embodiments, all of the dispensing directions D2*a* to D2*e* are the same.

The dispensing directions D2*a* to D2*e* have horizontal components D3*a*, D3*b*, D3*c*, D3*d* and D3*e* (the horizontal components D3*a* to D3*e* are illustrated under the dispensing directions D2*a* to D2*e* in FIG. 3). The horizontal angles A2 between the first extension axis AX1 and the horizontal components D3*a* to D3*e* are in a range from about 10 degrees to about 160 degrees.

As shown in FIG. 3, the horizontal components D3*a* to D3*e* are different. The horizontal angles A2 of the horizontal components D3*a* to D3*e* of the first liquid nozzles 33 are gradually and progressively greater from the first liquid nozzle 33 adjacent to the edge of the polishing pad 21 to the first liquid nozzle 33 adjacent to the center of the polishing pad 21.

In some embodiments, the horizontal component D3*a* of the first liquid nozzle 33 adjacent to the edge of the polishing pad 21 is in a range from about 10 degrees to about 60 degrees. In some embodiments, the horizontal component D3*e* of the first liquid nozzle 33 adjacent to the center of the polishing pad 21 is in a range from about 120 degrees to about 160 degrees. In some embodiments, at least two of the horizontal components D3*a* to D3*e* are the same. In some embodiments, all of the horizontal components D3*a* to are the same.

The slurry nozzles 34 are disposed on the first dispensing arm 32. The slurry nozzles 34 are configured to dispense slurry on the polishing surface 211. In some embodiments, the slurry nozzles 34 are located at the end of the first dispensing arm 32 adjacent to the center of the polishing pad 21. In some embodiments, the first dispensing device 30 includes one slurry nozzle 34. In some embodiments, the slurry includes polishing powder.

As shown in FIG. 1, the second dispensing device 40 is disposed on the base 10. In some embodiments, the first and the second dispensing devices 30 and 40 are located at two opposite sides of the polishing pad 21. In some embodiments, the structure of the second dispensing device 40 is substantially the same as the structure of the first dispensing device 30.

The second dispensing device 40 is configured to dispense washing liquid onto the polishing surface 211 of the polishing pad 21. The second dispensing device 40 includes a second support 41, a second dispensing arm 42, and a number of second liquid nozzles 43. The second support 41 is disposed on the base 10.

The second dispensing arm 42 is disposed on the second support 41. The second dispensing arm 42 is located over the polishing pad 21. In some embodiments, the second dispensing arm 42 is a linear structure extended along a second extension axis AX2. In some embodiments, the second extension axis AX2 is parallel to the polishing surface 211. The second extension axis AX2 substantially passes though the center of the polishing pad 21. In some embodiments, the second extension axis AX2 overlaps the first extension axis AX1. In some embodiments, the second dispensing arm 42 is a telescoping dispensing arm.

The second liquid nozzles 43 are disposed on the second dispensing arm 42. In some embodiments, the structure of the second liquid nozzles 43 is substantially the same as the structure of the first liquid nozzles 33. In some embodiments, the second liquid nozzles 43 are arranged on the second dispensing arm 42 along the extension direction D1.

The second liquid nozzles 43 are configured to dispense the washing liquid onto the polishing surface 211. In some embodiments, each of the angles of the second liquid nozzles 43 is adjustable. Since the angles and the directions of the second liquid nozzles 43 is similar to the angles and the directions of the first liquid nozzles 33 as shown in FIGS. 2 and 3, the further description of the angles and the directions of the second liquid nozzles 43 is omitted for sake of brevity.

As shown in FIG. 1, the retaining device 50 is disposed on the base 10. The retaining device 50 is configured to dispose the wafer W1 on the polishing surface 211. The retaining device 50 includes a first moving mechanism 51, a first rotation element 52, and a retaining element 53. The first moving mechanism 51 is disposed on the base 10. The first moving mechanism 51 is configured to move the retaining element 53. The first rotation element 52 is disposed on the first moving mechanism 51. The first rotation element 52 is configured to rotate the retaining element 53.

The retaining element 53 is disposed on the first rotation element 52. The retaining element 53 is configured to retaining the wafer W1. In some embodiments, the retaining element 53 is a sucking disc. The retaining element 53 retains the wafer W1 by drawing the upper surface of the wafer W1. The area of the retaining element 53 is substantially the same as the wafer W1.

As shown in FIG. 1, the roughening device 60 is disposed on the base 10. The roughening device 60 is configured to roughen the polishing surface 211. The roughening device 60 includes a second moving mechanism 61, a second rotation element 62, and a roughening disk 63. The second moving mechanism 61 is disposed on the base 10. The second moving mechanism 61 is configured to move the roughening disk 63. The second rotation element 62 is disposed on the second moving mechanism 61. The second rotation element 62 is configured to rotate the roughening disk 63.

The roughening disk 63 is disposed on the second rotation element 62. The roughening disk 63 is configured to roughen the polishing surface 211. In some embodiments, the roughening disk 63 includes a hardness material on a lower surface of the roughening disk 63. In some embodiments, the hardness material includes a number of diamond particles. The lower surface contacts or faces the polishing surface 211 during a roughening process.

Figure 4:
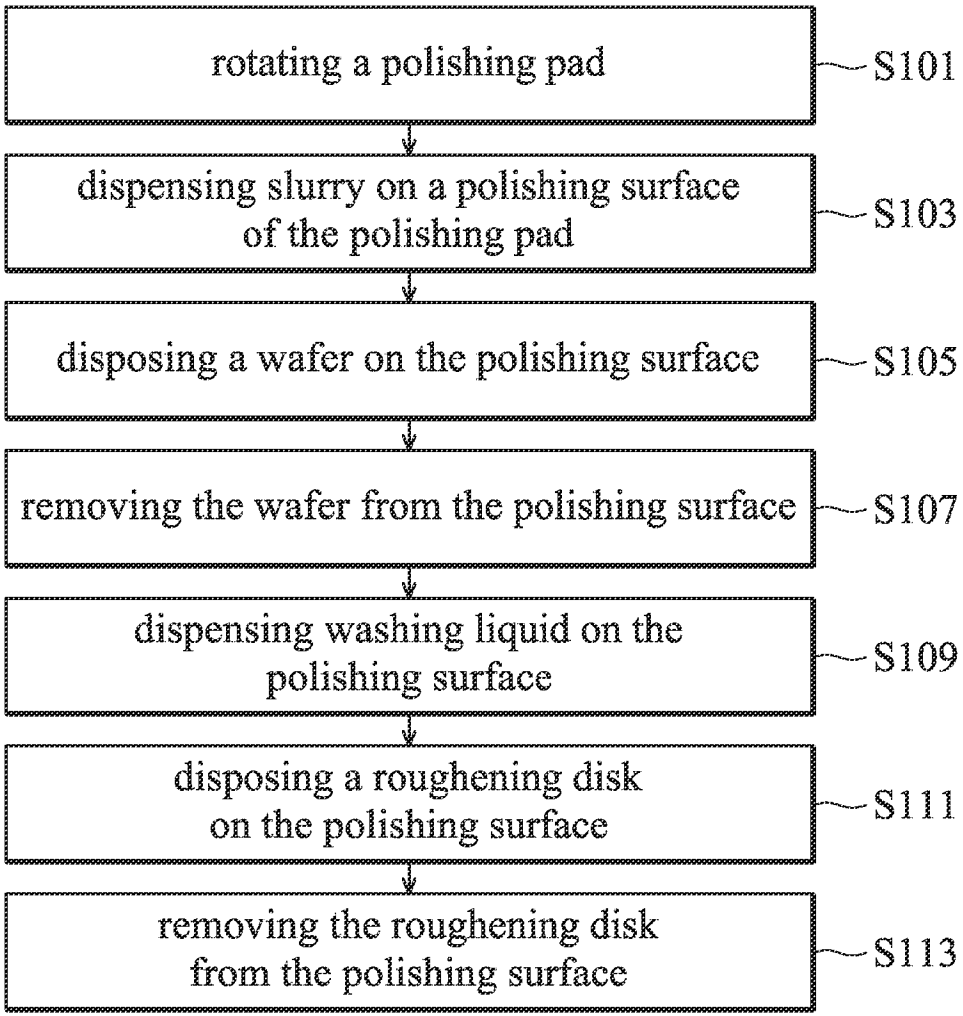
FIG. 4 is a flow chart of a polishing method in accordance with some embodiments of the disclosure.
Figure 5A:
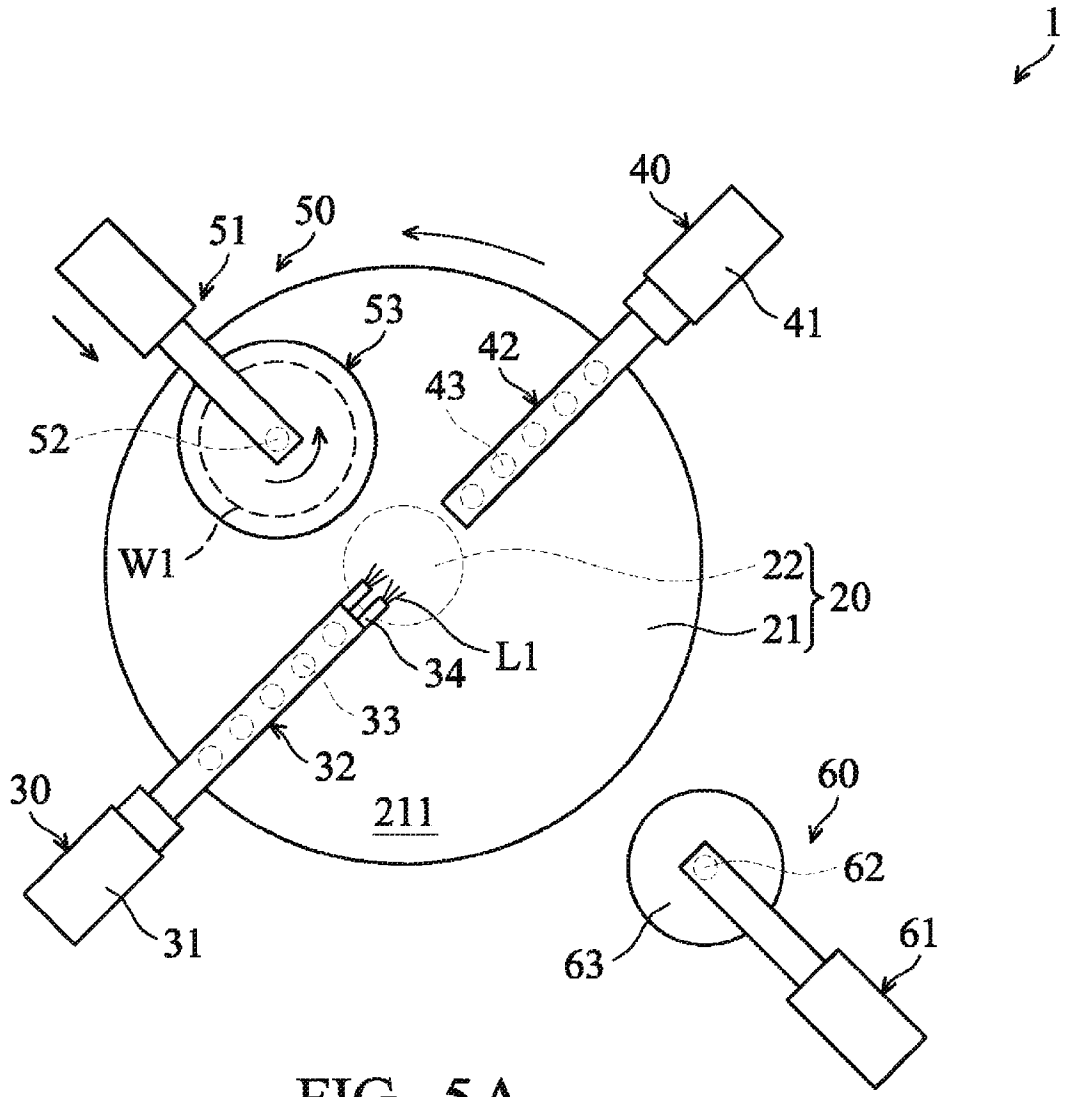
FIGS. 5A to 5F are top views or side views of the polishing apparatus during processes in accordance with some embodiments of the disclosure.
Figure 5B:
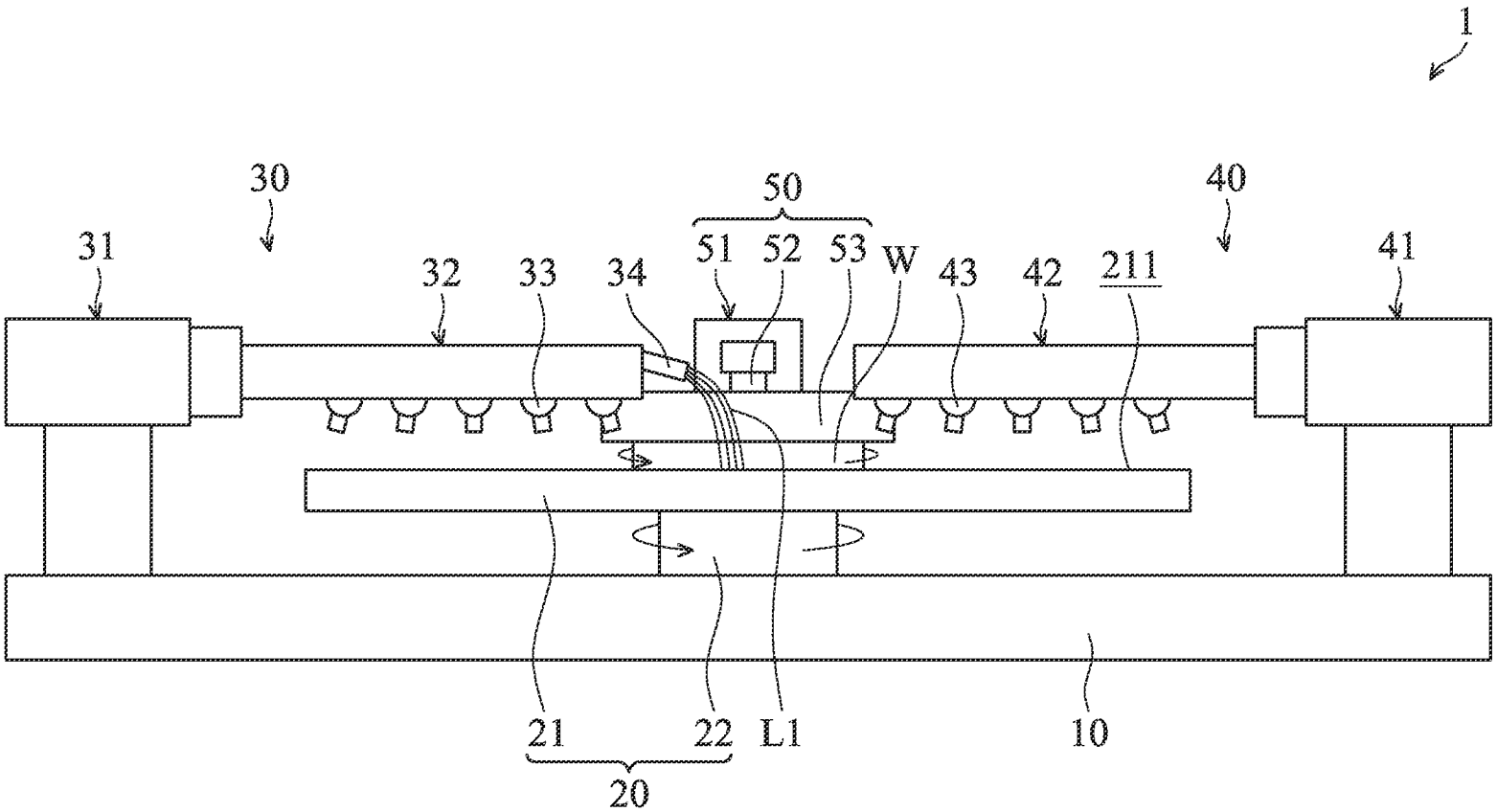

FIG. 4 is a flow chart of a polishing method in accordance with some embodiments of the disclosure. FIG. 5A is a top view of the polishing apparatus 1 during a polishing process in accordance with some embodiments of the disclosure. FIG. 5B is a side view of the polishing apparatus 1 during the polishing process in accordance with some embodiments of the disclosure. As shown in FIGS. 4, 5A and 5B, in step S101, the polishing pad 21 is rotated by the rotation mechanism 22. The rotational speed of the polishing pad 21 is in a range from about 50 rpm to about 120 rpm.

In the step S103, the first dispensing device 30 dispenses slurry L1 onto the center area of the polishing surface 211 of the polishing pad 21 via the slurry nozzle 34. Sine the polishing pad 21 is rotated, the slurry L1 is distributed on the polishing surface 211 by a centrifugal force. In some embodiments, the position of the slurry nozzle 34 is changed by adjusting the length of the first dispensing arm 32. Therefore, the slurry L1 is uniformly dispensed onto the polishing surface 211.

In the step S105, the wafer W1 is disposed on the polishing surface 211 by the retaining device 50. A lower surface of the wafer W1 facing the polishing surface 211 is polished by the polishing pad 21 during the polish process. The slurry L1 is continually dispensed by the first dispensing device 30 during polishing the wafer W1. In general, the polishing surface 211 is rough. The wafer W1 is polished by the polishing surface 211 by the relative movement between the wafer W1 and the polishing pad 21.

In some embodiments, the first moving mechanism 51 moves the wafer W1 on the polishing surface 211 as shown in FIGS. 5A and 5B. Afterwards, the wafer W1 is rotated on the polishing surface 211 by the first rotation element 52. In some embodiments, the rotational speed of the wafer W1 is in a range from about 50 rpm to about 120 rpm.

Furthermore, the wafer W1 is pressed on the polishing surface 211 by the first moving mechanism 51. In some embodiments, the force applied on the wafer W1 by the first moving mechanism 51 is in a range from about 50 nt to about 500 nt.

Figure 5C:
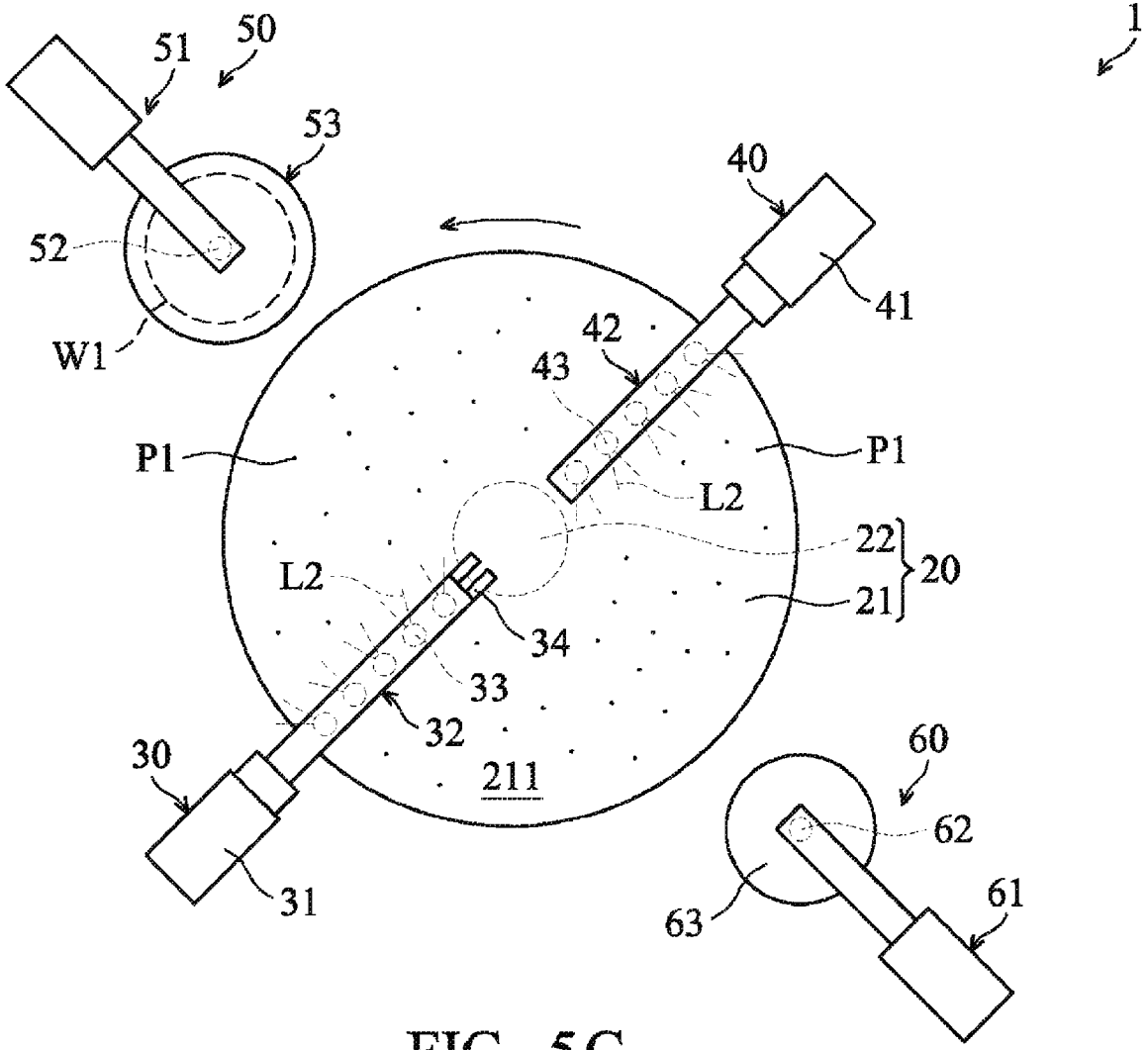
Figure 5D:
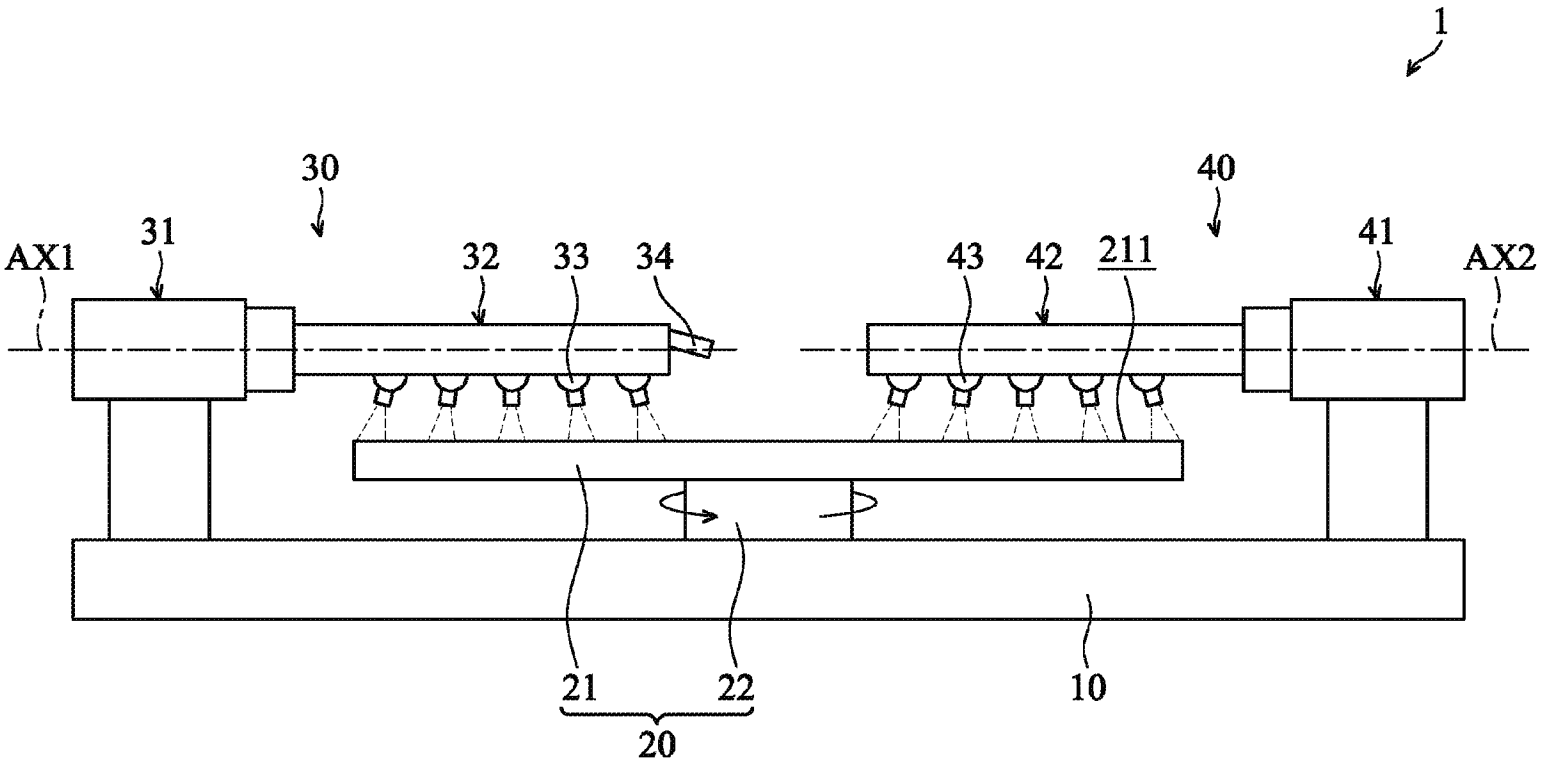

FIG. 5C is a top view of the polishing apparatus 1 during a cleaning process in accordance with some embodiments of the disclosure. FIG. 5D is a side view of the polishing apparatus 1 during the cleaning process in accordance with some embodiments of the disclosure. In the step 107, as shown in FIG. 5C and FIG. 5D, the wafer W1 is removed from the polishing surface 211 by the first moving mechanism 51 after the wafer W1 is polished.

In general, there some particles P1 are remained on the polishing pad 21 after the wafer W1 is polished. In the step S109, the first and the second dispensing devices 40 dispense the washing liquid onto the polishing surface 211 after the wafer W1 is removed. During the washing liquid is dispensed, the polishing pad 21 is continually rotated. Therefore, the particles P1 are washed away by the washing liquid. In some embodiments, by the dispensing directions of the washing liquid, the force of the washing liquid impacting the particles P1 on the polishing surface 211 is increased. Furthermore, since the first and the second liquid nozzles 33 and 43 are located over two opposite sides of the center of the polishing surface 211, the washing liquid flows through most area of the polishing surface 211. Therefore, the cleanness efficiency of the polishing pad 21 is improved.

In some embodiments, the position of the first and the second liquid nozzles 33 and 43 are changed by adjusting the length of the first and the second dispensing arms 32 and 42 to improve the cleanness efficiency of the polishing pad 21.

In general, after the wafer W1 is polished on the polishing surface 211, the roughness of the polishing surface 211 is decreased. Therefore, the roughening disk 63 is used to increase the roughness of the polishing surface 211.

Figure 5E:
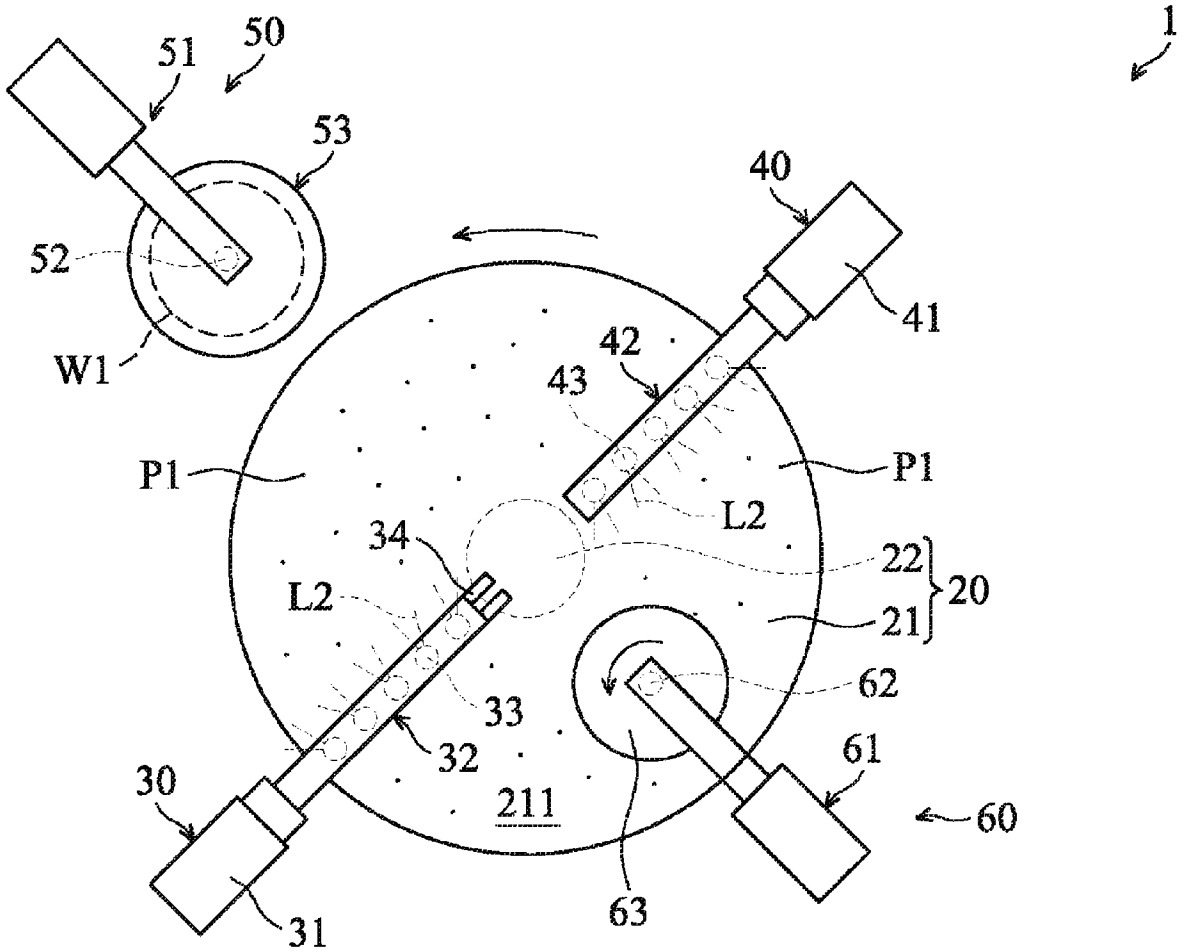
Figure 5F:
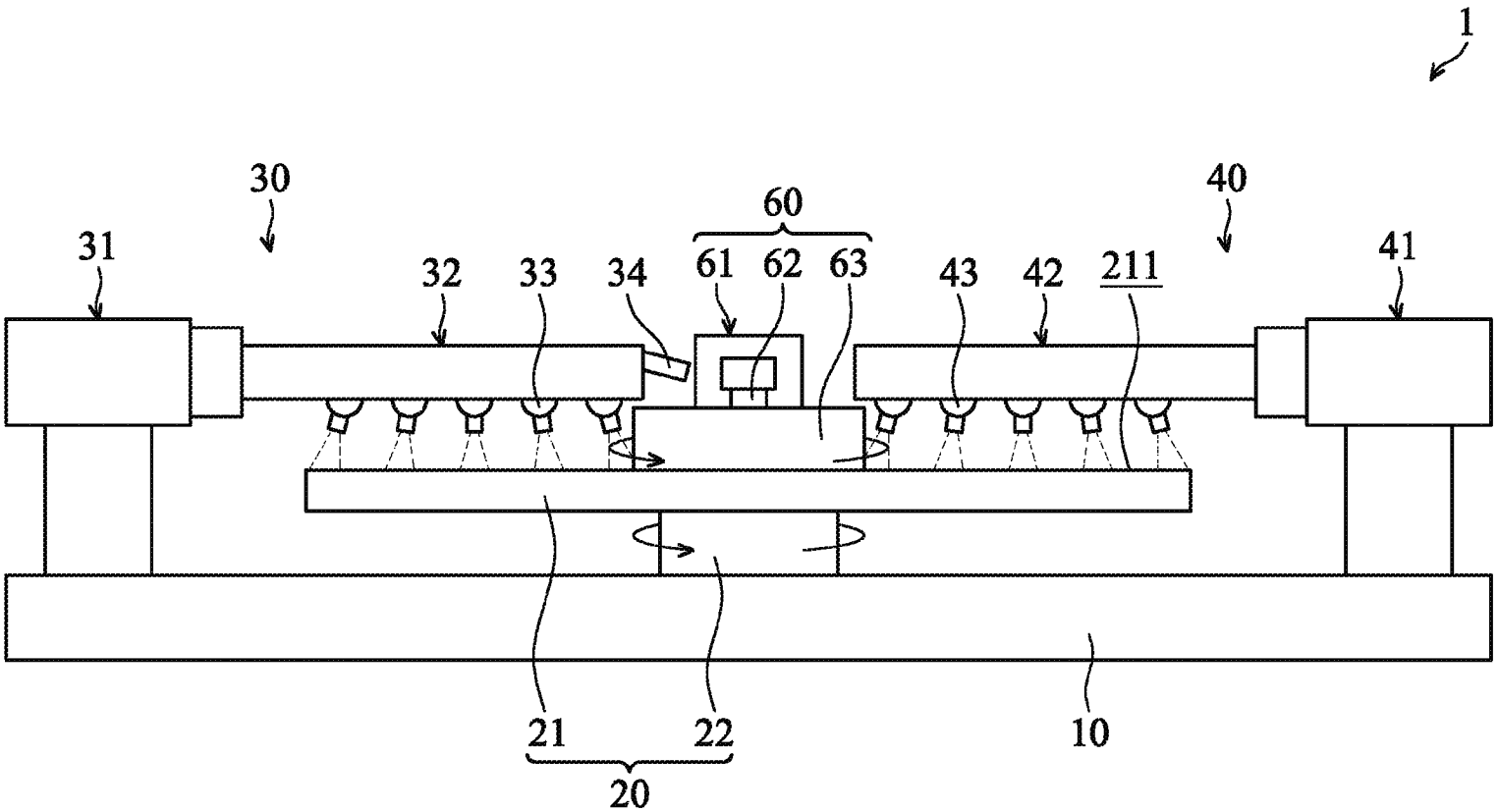

FIG. 5E is a top view of the polishing apparatus 1 during the roughening process in accordance with some embodiments of the disclosure. FIG. 5F is a side view of the polishing apparatus 1 during the roughening process in accordance with some embodiments of the disclosure. In the step S111, the roughening disk 63 is disposed on the polishing surface 211 by the second moving mechanism 61 to roughen the polishing surface 211.

The roughening disk 63 is rotated by the second rotation element 62. In some embodiments, the rotational speed of the roughening disk 63 is in a range from about 20 rpm to about 80 rpm. Furthermore, the roughening disk 63 is pressed on the polishing surface 211 by the second moving mechanism 61. In some embodiments, the force applied on the roughening disk 63 by the second moving mechanism 61 is in a range from about 100 nt to about 800 nt.

Since the lower surface of the roughening disk 63 has hardness material, such as diamond particles, the polishing surface 211 is roughed by the relative movement between the roughening disk 63 and the polishing pad 21.

When the polishing surface 211 is roughed by the roughening disk 63, there are some particles P1 are generated on the polishing surface 211. Therefore, the first and the second dispensing devices 40 dispense the washing liquid on the polishing surface 211. Furthermore, the polishing pad 21 is rotated. The particles P1 are washed away by the washing liquid.

In the step S113, the roughening disk 63 is removed from the polishing surface 211 by the second moving mechanism 61. The first and the second dispensing devices 40 stop dispensing the washing liquid onto the polishing surface 211.

Embodiments of a polishing apparatus are provided. The polishing apparatus includes a number of dispensing devices. The dispensing devices dispense washing liquid on a polishing surface of a polishing pad. In some embodiments, the dispensing devices are located at two opposite sides of the polishing pad. Therefore, the washing liquid flows through most area of the polishing surface, and the particles on the polishing surface are washed by the washing liquid. Furthermore, the dispensing devices dispense washing liquid onto the polishing surface along dispensing directions. The dispensing directions have acute angles with respect to the polishing surface. Therefore, the force of the washing liquid impacting the particles on the polishing surface is increased. The cleanness efficiency of the polishing pad is improved.

In some embodiments, the polishing apparatus is provided. The polishing apparatus includes a polishing pad having a polishing surface. The polishing apparatus also includes a dispensing device including a dispensing arm located over the polishing pad and a liquid nozzle disposed on the dispensing arm. The liquid nozzle is configured to dispense washing liquid onto the polishing surface along a dispensing direction. The dispensing direction has an acute angle with respect to the polishing surface.

In some embodiments, the polishing apparatus is provided. The polishing apparatus includes a polishing pad having a polishing surface. The polishing apparatus also includes a first dispensing device including a first dispensing arm located over the polishing pad and a first liquid nozzle, disposed on the first dispensing arm. The first liquid nozzle is configured to dispense washing liquid onto the polishing surface along a first dispensing direction. The polishing apparatus further includes a second dispensing device including a second dispensing arm located over the polishing pad and a second liquid nozzle disposed on the second dispensing arm. The second liquid nozzle is configured to dispense washing liquid onto the polishing surface along a second dispensing direction. The first dispensing direction has a first acute angle with respect to the polishing surface, and the second dispensing direction has a second acute angle with respect to the polishing surface.

In some embodiments, the polishing method is provided. The polishing method includes rotating a polishing pad and dispensing slurry on a polishing surface of the polishing pad. The polishing method also includes disposing a wafer on the polishing surface and removing the wafer from the polishing surface. The polishing method further includes dispensing washing liquid on the polishing surface along a first dispensing direction via a first liquid nozzle of a first dispensing arm. The first dispensing direction has a first acute angle with respect to the polishing surface.

Although embodiments of the present disclosure and their advantages have been described in detail, it should be understood that various changes, substitutions and alterations can be made herein without departing from the spirit and scope of the disclosure as defined by the appended claims. For example, it will be readily understood by those skilled in the art that many of the features, functions, processes, and materials described herein may be varied while remaining within the scope of the present disclosure. Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps. In addition, each claim constitutes a separate embodiment, and the combination of various claims and embodiments are within the scope of the disclosure.

What is claimed is:

1. A polishing apparatus, comprising:

a polishing pad having a polishing surface; and a dispensing device comprising:

a dispensing arm located over the polishing pad and extending from a first end to a second end along an extension axis located on a horizontal plane parallel to the polishing surface; and a plurality of liquid nozzles, disposed on the dispensing arm, configured to dispense washing liquid onto the polishing surface along dispensing directions having acute angles with respect to the polishing surface;

wherein, viewed from a direction normal to the horizontal plane, angles formed between the extension axis and the dispensing directions are progressively greater and increased from an angle smaller than 90 degrees to an angle greater than 90 degrees from one of the liquid nozzles adjacent to the first end to one of the liquid nozzles adjacent to the second end.

2. The polishing apparatus as claimed in claim 1, wherein the acute angles are in a range from about 20 degrees to about 80 degrees.

3. The polishing apparatus as claimed in claim 1, wherein, viewed from a direction normal to the horizontal plane, the angles formed between the extension axis and dispensing directions are in a range from about 10 degrees to about 160 degrees.

4. The polishing apparatus as claimed in claim 1, wherein the first end of the dispensing arm is adjacent to an edge of the polishing pad, and the second end of the dispensing arm is adjacent to a center of the polishing pad.

5. The polishing apparatus as claimed in claim 1, wherein the dispensing device further comprises a slurry nozzle disposed on the dispensing arm and configured to dispense slurry on the polishing surface.

6. The polishing apparatus as claimed in claim 1, further comprising a retaining device configured to dispose a wafer on the polishing surface.

7. A polishing apparatus, comprising:

a polishing pad having a polishing surface;

two dispensing devices positioned over two sides of the polishing pad and each comprising:

a dispensing arm located over the polishing pad and extending from a first end to a second end along an extension axis located on a horizontal plane parallel to the polishing surface; and a plurality of liquid nozzles, disposed on the dispensing arm, configured to dispense washing liquid onto the polishing surface along dispensing directions having acute angles with respect to the polishing surface;

wherein, viewed from a direction normal to the horizontal plane, angles formed between the extension axis and the dispensing directions are progressively greater and increased from an angle smaller than 90 degrees to an angle greater than 90 degrees from one of the liquid nozzles adjacent to the first end to one of the liquid nozzles adjacent to the second end.

8. The polishing apparatus as claimed in claim 7, wherein the first acute angles are in a range from about 20 degrees to about 80 degrees.

9. The polishing apparatus as claimed in claim 7, wherein, viewed from a direction normal to the horizontal plane, the angles formed between the extension axis and dispensing directions are in a range from about 10 degrees to about 160 degrees.

10. The polishing apparatus as claimed in claim 7, wherein each of the dispensing devices comprises a slurry nozzle disposed on the dispensing arm and configured to dispense slurry on the polishing surface.

11. The polishing apparatus as claimed in claim 7, further comprising a retaining device configured to dispose a wafer on the polishing surface.

12. The polishing apparatus as claimed in claim 7, further comprising a roughening device configured to roughen the polishing surface.

13. The polishing apparatus as claimed in claim 7, wherein the liquid nozzles of the two dispensing devices are oriented to a leading side of the corresponding dispensing arm relative to a rotation direction of the polishing pad.

14. A polishing method, comprising:

rotating a polishing pad;

dispensing slurry on a polishing surface of the polishing pad;

disposing a wafer on the polishing surface;

removing the wafer from the polishing surface; and dispensing washing liquid on the polishing surface by a dispensing device positioned over a first side of the polishing pad, wherein the dispensing device comprises:

a dispensing arm located over the polishing pad and extending from a first end to a second end along an extension axis located on a horizontal plane parallel to the polishing surface; and a plurality of liquid nozzles, disposed on the dispensing arm, configured to dispense washing liquid onto the polishing surface along dispensing directions having acute angles with respect to the polishing surface;

wherein, viewed from a direction normal to the horizontal plane, angles formed between the extension axis and the dispensing directions are progressively greater and increased from an angle smaller than 90 degrees to an angle greater than 90 degrees from one of the liquid nozzles adjacent to the first end to one of the liquid nozzles adjacent to the second end.

15. The polishing method as claimed in claim 14, wherein the first acute angles are in a range from about 20 degrees to about 80 degrees.

16. The polishing method as claimed in claim 14, wherein viewed from a direction normal to the horizontal plane, the angles formed between the extension axis and dispensing directions are in a range from about 10 degrees to about 160 degrees.

17. The polishing method as claimed in claim 14, further comprising dispensing washing liquid on the polishing surface by another dispensing device positioned at a second side of the polishing pad.

18. The polishing method as claimed in claim 14, further comprising rotating the wafer on the polishing surface by a retaining element.

19. The polishing method as claimed in claim 14, further comprising:

disposing a roughening disk on the polishing surface; and removing the roughening disk from the polishing surface.

20. The polishing method as claimed in claim 17, wherein said another dispensing device comprises a plurality of liquid nozzles disposed on a second dispensing arm and wherein the liquid nozzles of the two dispensing devices are oriented to a leading side of the corresponding dispensing arm relative to a rotation direction of the polishing pad.

* * * * *